US005930986A

United States Patent [19]

Meaghan et al.

[11] Patent Number: 5,930,986

[45] Date of Patent: Aug. 3, 1999

[54] STIRRUP WITH A MOVEABLE FOOT PLATE

[75] Inventors: Robert C. Meaghan, Belford; Robyn E. Davidson, Little Falls, both of N.J.

[73] Assignee: Miller Harness Company, Inc., East Rutherford, N.J.

[21] Appl. No.: 08/947,181

[22] Filed: Oct. 8, 1997

Related U.S. Application Data

[60] Provisional application No. 60/033,912, Dec. 23, 1996.

[51] Int. Cl.[6] ..... B68C 3/02

[52] U.S. Cl. ..... 54/47

[58] Field of Search ..... 54/47, 49

[56] References Cited

U.S. PATENT DOCUMENTS

| | | | |
|---|---|---|---|
| D. 383,572 | 9/1997 | Rea | D30/142 |
| 739,170 | 9/1903 | Green | 54/49 |
| 756,270 | 4/1904 | McVey | 54/47 |
| 5,172,538 | 12/1992 | Luger | 54/47 |

FOREIGN PATENT DOCUMENTS

| | | | |
|---|---|---|---|
| A 62109/90 | 3/1991 | Australia . | |
| A-62109/90 | 3/1991 | Australia . | |
| 40184 | 7/1887 | Germany | 54/49 |
| 1560465 | 4/1990 | U.S.S.R. . | |
| 1131665 | 10/1968 | United Kingdom . | |

OTHER PUBLICATIONS

The Official Award Saddle of World Cup Polo –p. 40 (Advertisement) Palm Beach, Florida Apr. 1993.

Fittings–p. 17 (Advertisement).

*Primary Examiner*—Robert P. Swiatek

*Attorney, Agent, or Firm*—Lerner, David, Littenberg, Krumholz & Mentlik, LLP

[57] ABSTRACT

A stirrup for use in equestrian and other riding with traditional looking features has a pivotable footplate for ease of mounting and dismounting as well as for proper heels down, toes up positioning of the rider's foot while riding. A support bar extending between the side bars of the stirrup is included for adding strength and stability to the stirrup as well as to facilitate the pivoting action of the footplate. Side bar grooves also are included on the ends of the footplate which have bearing surfaces to provide a positive stop for the side bars such that the footplate is limited in rotation to a predetermined angle in relation to the side bars.

7 Claims, 4 Drawing Sheets

STIRRUP WITH A MOVEABLE FOOT PLATE

CROSS REFERENCE

This application claims the benefit of United States Provisional Patent Application Serial No. 60/033,912 filed Dec. 23, 1996, the disclosure of which is incorporated by reference herein.

BACKGROUND OF THE INVENTION

The present invention is directed to a stirrup for use in equestrian and other riding and more particularly to a stirrup with a pivotable footplate.

Stirrups are an integral part of riding gear used by most equestrian or other riders. In general, riders use stirrups to retain or secure their feet while riding and while performing various riding maneuvers. Moreover, riders use stirrups to maintain proper posture, balance and maneuverability. Riders also need to easily and quickly maneuver in and out of their stirrups at certain times, especially during mounting and dismounting.

In most situations, riders must maintain proper footing in the stirrups to achieve a proper posture, balance and maneuverability. One way riders do this is by placing the balls of their feet on the stirrups' footplates and flexing their ankles so that their toes point upward and their heels point downward. This positioning encourages the riders' weight to be balanced and to drop down through their heels. Riders also desire to keep the full weight of the balls of their feet resting on the footplates at all times to avoid or reduce leg fatigue and help maintain their posture and balance.

In conventional stirrups, the side bars and the footplate are an integral piece or the footplate is attached to the side bars such that the footplate cannot move independently from the side bars. Stirrups hang down from the saddle generally in a vertical plane, perpendicular to the ground, with the footplate being generally parallel to the ground. As such, to achieve a position with the heels lower then the toes, the complete stirrup has to swivel to an angle off vertical, the point of rotation being at the top of the stirrup where the stirrup is attached to riding straps, commonly known as stirrup "leathers." Therefore, it is desirable to have a stirrup with a footplate that pivots substantially independently from the side bars or frame. This would ensure that the complete stirrup itself would not have to be extended to as great an angle (from the vertical) as in a conventional stirrup. As a result, the rider need not extend his or her leg as far to keep their heels lower than their toes.

Prior designs for stirrups having swivel action include the "HS Hinged Stirrup" by Herm Sprenger of Germany. This stirrup is hinged near the lower portions of both side bars. It includes rubber tubing which surrounds the hinges. Another similar design, i.e., one with hinges located on the side bars, is the "Polo Swivel Stirrup" by Miller's Harness Company, Inc. of New Jersey, the assignee of the present invention. This design does not, however, provide a means for limiting the pivoting action of the stirrup's footplate to a desired angle. This lack of a positive stop may be detrimental to the desired objects of posture, balance and maneuverability. These stirrups also do not provide for a support member for supporting the footplate and adding durability to the overall design of the stirrup. Finally, the hinges are located along the side bars which diminishes the aesthetic appearance of a traditional stirrup.

In United Kingdom Patent No. 1,131,665, issued to Jeffries, et al., a stirrup with a pivoting footplate is disclosed.

This patent discloses stop means for limiting the range of rotation of the footplate. However, the hinging is achieved by way of a pair of cylindrical spindles and sockets. Also, this hinging mechanism is visible and thus deviates from the traditional looking stirrups. Furthermore, much of the forces produced by riders are concentrated at the hinges or spindles.

The present invention addresses the need for a durable, sturdy flexible stirrup which is aesthetically pleasing, yet functional in facilitating proper posture, balance and maneuverability. The present invention also addresses the need to have a positive stop or bearing surface which limits the rotation of the footplate to a predetermined angle in relation to the side bars while retaining a traditional stirrup appearance. Finally, the present invention provides a construction which is inexpensive to manufacture while providing sought-after functional advantages.

SUMMARY OF THE INVENTION

One aspect of the present invention is directed to a stirrup for an equestrian or other rider comprising a frame having a pair of side bars, a support bar extending between the side bars, and a footplate positioned between the side bars, the footplate being supported by the support bar, the side bars and the footplate defining an opening for receiving the rider's foot therethrough, and the footplate being pivotable with respect to the side bars.

In a preferred embodiment, the support bar is fixed to the side bars and the footplate is pivotably fixed to the support bar.

In a further preferred embodiment, the side bars define openings and the support bar is press-fit into these openings of the side bars.

In yet another preferred embodiment, the footplate further comprises side bar grooves in which the side bars are disposed. In this preferred embodiment, the side bar grooves include front and back bearing walls such that when the footplate is pivoted, the side bars bear against either the front or the back bearing walls to thereby limit the angle to which the footplate pivots.

In yet a more preferred embodiment, the footplate includes a top portion and a bottom portion. At least the front bearing walls of the side bars grooves are at least partially tapered toward the respective side bar from the top portion of the footplate to the bottom portion of the footplate.

In another preferred embodiment, the back bearing walls of the side bar grooves are vertical from the top portion to the bottom portion of the footplate.

In yet another preferred embodiment, the footplate has a top portion and bottom portion. Both front and back bearing walls of the side bar grooves taper toward the respective side bars from the top portion of the footplate to the bottom portion of the footplate.

Another aspect of the present invention includes a stirrup for use by a rider comprising a frame, the frame having a pair of side bars and a footplate having a top portion and a bottom portion. The footplate is positioned between, and pivotable with respect to, the side bars. The side bars and the footplate define an opening for receiving the rider's foot therethrough. The footplate also includes side bar grooves which include front bearing walls and back bearing walls. The front bearing walls of the side bar grooves are at least partially tapered toward the respective side bars from the top portion of the footplate to the bottom portion of the footplate, such that when the footplate pivots, the side bars bear against either of the front or the back bearing walls to thereby limit the angle to which the footplate pivots. In a most preferred embodiment of this aspect of the invention, the back bearing walls are vertical from the top portion to the bottom portion of the footplate.

BRIEF DESCRIPTION OF THE DRAWINGS

The above and other objects and advantages of the present invention will become apparent, as will a better understanding of the concepts underlying the present invention by reference to the description which follows and refers to the accompanying drawings in which.

DETAILED DESCRIPTION OF PREFERRED EMBODIMENTS

The present invention concerns riding stirrups which have pivotable footplates. That is, the present invention concerns stirrups where the footplate is able to pivot or swivel independently from the frame portion of the stirrup. The terms pivot or swivel are used interchangeably to refer to the pivotal movement of the footplate relative to the frame.

Figure 3:
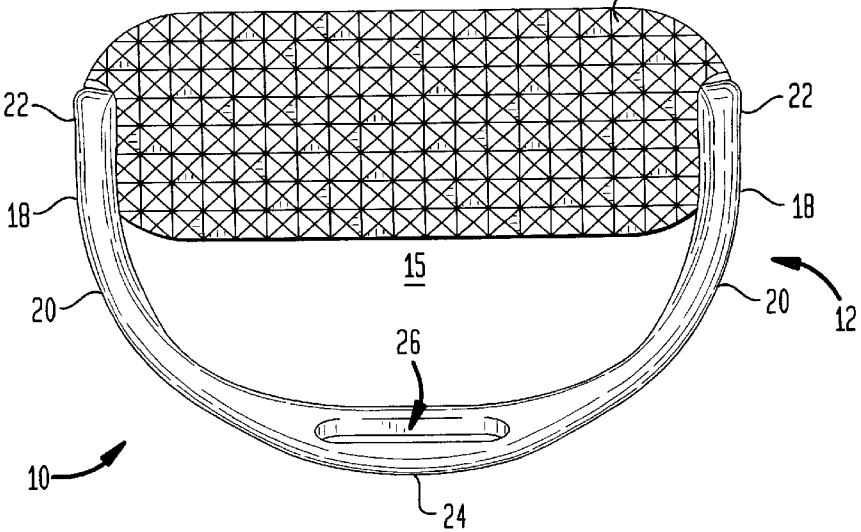
FIG. 3 is a top plan view of the stirrup of FIGS. 1 and 2, showing the footplate pivoted against one pair of bearing walls of the side bar grooves.
Figure 1:
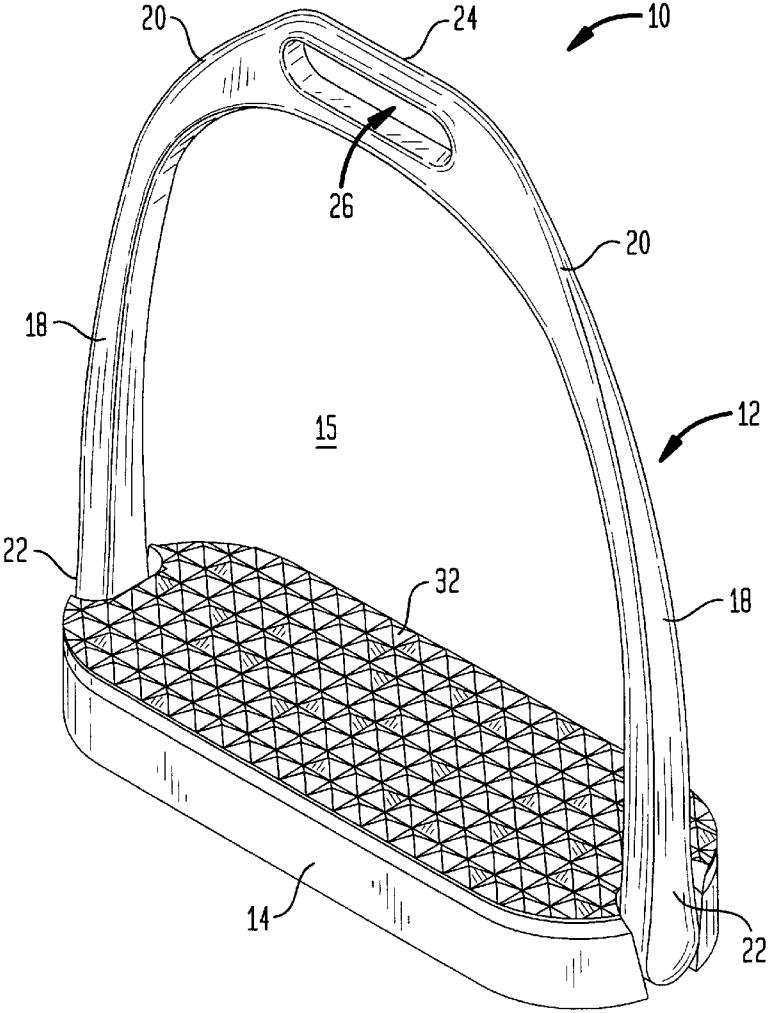
FIG. 1 is a perspective view of a stirrup in accordance with one embodiment of the present invention showing the side bars disposed in the side bar grooves.
Figure 2:
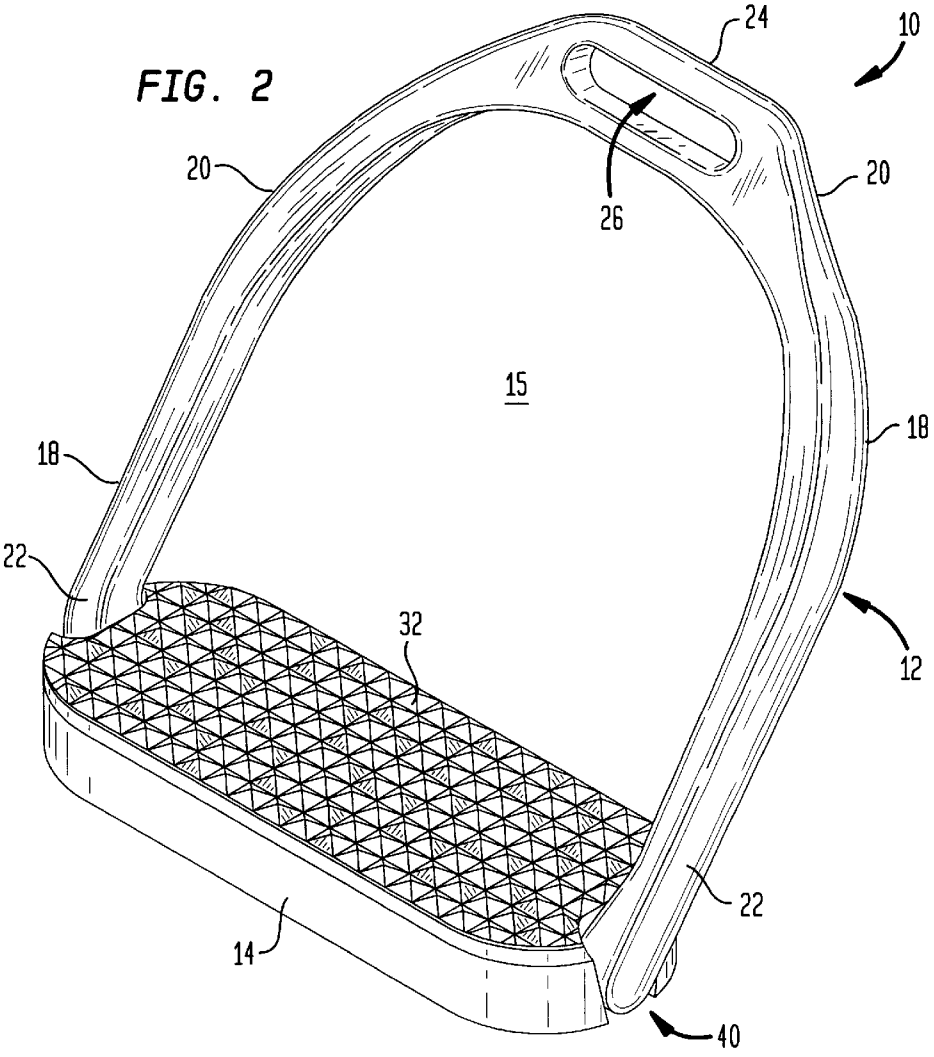
FIG. 2 is a perspective view of the stirrup of FIG. 1 showing the footplate pivoted such that the side bars are bearing against a pair of bearing walls of the side bar grooves.

In one embodiment of the present invention, as shown in FIGS. 1, 2 and 3, a stirrup 10 comprises a frame 12, a support bar 16 (see FIG. 4) attached to the frame 12 and a footplate 14 pivotably attached to the support bar 16. The frame 12 and footplate 14 define an opening 15 for receiving a rider's foot.

The frame 12, in this preferred embodiment, is substantially U-shaped when inverted. The frame 12 further comprises a pair of side bars 18 which form a portion of the frame 12. The side bars 18 are substantially parallel to each other and are generally located in the same vertical plane. Each side bar 18 includes upper ends 20 and lower ends 22. The upper ends 20 are joined by an integral portion 24. The integral portion defines an opening 26. This opening 26 is provided generally for receiving a strap or stirrup "leather" therethrough which may be used to secure the stirrup 10 to another portion of the riding gear such as the rider's saddle. The lower ends 22 define receiving holes (not shown) for receiving the ends of the support bar 16.

Figure 4:
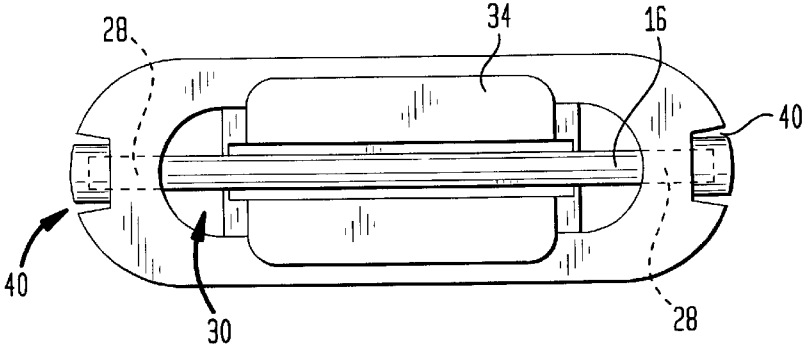
FIG. 4 is a bottom plan view of the stirrup of FIGS. 1, 2 and 3 showing the support bar extending from one side bar to the other, and the lip portions of the traction member extending through an elongated oval hole defined by the perimeter of the footplate.
Figure 5:
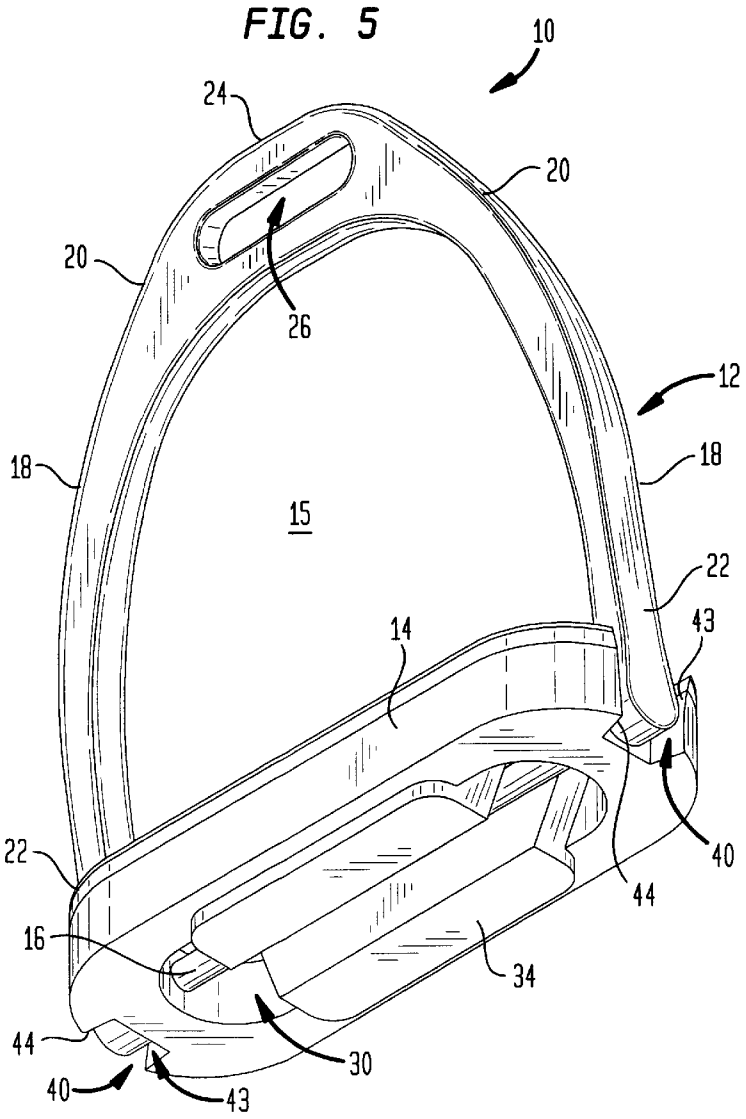
FIG. 5 is a perspective view of the stirrup of FIGS. 1–4 with the footplate pivoted, and showing the underside of the stirrup including the support bar.

As shown in FIGS. 4 and 5, the ends of the support bar 16 are attached to the lower ends 22 of the side bars 18 of the frame 12, within the receiving holes (not shown) of the side bars 18. In this preferred embodiment, the ends of the support bar 16 are press-fit into the receiving holes of the lower ends 22. It should be understood that any means of securing the support bar to the side bars 18 is contemplated by the present invention.

By way of example, the support bar also may be secured to the side bars 18 by means of a double ended threaded bolt with two nuts. That is, the ends of the support bar are threaded, with the receiving holes of the side bars 18 having corresponding receiving threads. The support bar 16 would then be screwed into the lower ends 22 of the side bars 18 and the threaded ends would extend beyond the outside of the side bars 18. The two nuts would be secured to the support bar ends on the outer sides of the side bars 18 to secure the support bar 16 to the frame 12. In addition to the above, the support bar 16 also may be welded, cemented or glued to the side bars 18. The support bar 16 also may be rotatably fixed to the side bars 18. Finally, the support bar 16 may be integral with the side bars 18. Thus, it should be appreciated that the support bar 16 may be secured to the frame 12 in any fashion which results in the support bar 16 providing strength, support and overall stability to the stirrup 10 as well as support for the footplate 14.

The footplate 14 as shown in the drawings is pivotally attached to the support bar 16, between the lower ends 22 of the side bars 18, by means of mounting holes 28 (see FIGS. 4 and 5). In this preferred embodiment, the diameters of the mounting holes 28 are relatively slightly larger than the outside diameter of the support bar 16 such that the footplate 14 is pivotable about the support bar 16. The footplate 14 also defines an opening 30 which is shaped as a generally elongated oval.

In the alternative, the support bar 16 may be rotatably fixed to the side bars 18. If so, the footplate 14 may be fixed to the support bar 16. The footplate 14 will still pivot, in this case, by reason of the rotation of the support bar 16 with respect to the side bars 18.

A traction member 32, which may be made out of a flexible material such as rubber, has a pair of lips 34. The traction member 32 is disposed into the footplate 14, between the side bars 18. The lips 34 are fitted through the opening 30 and extend outwardly beyond the diameter of the opening 30 and thus are attached to the footplate 14 in a wedge-like manner. In this way, the traction member 32 is removably secured to the footplate 14.

Figure 6:
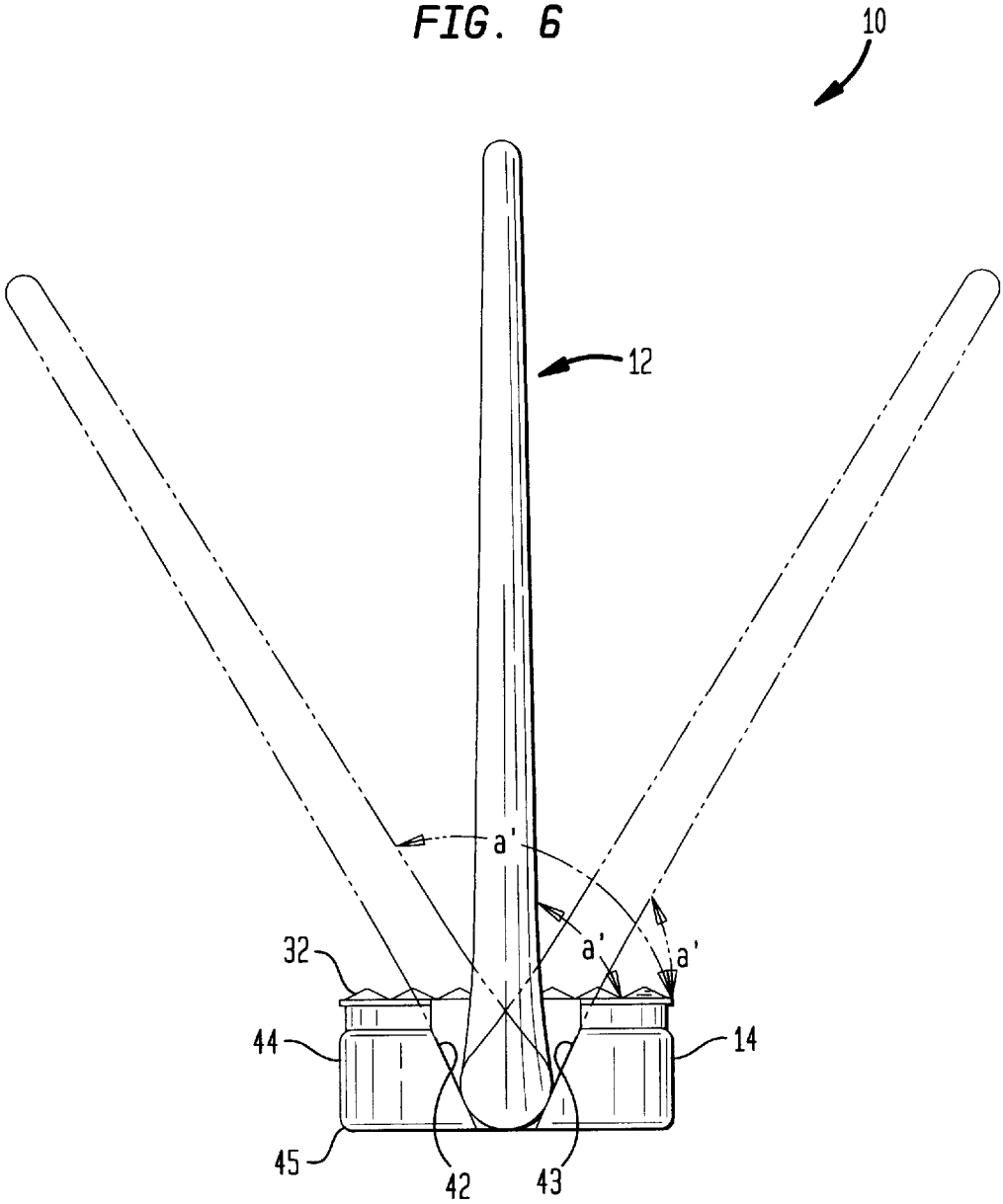
FIG. 6 is side elevation view of the stirrup of FIGS. 1–5 showing the front and back bearing surfaces of the side bar grooves of the footplate, where both pairs of the bearing surfaces taper from the top portion to the bottom portion of the footplate.
Figure 8:
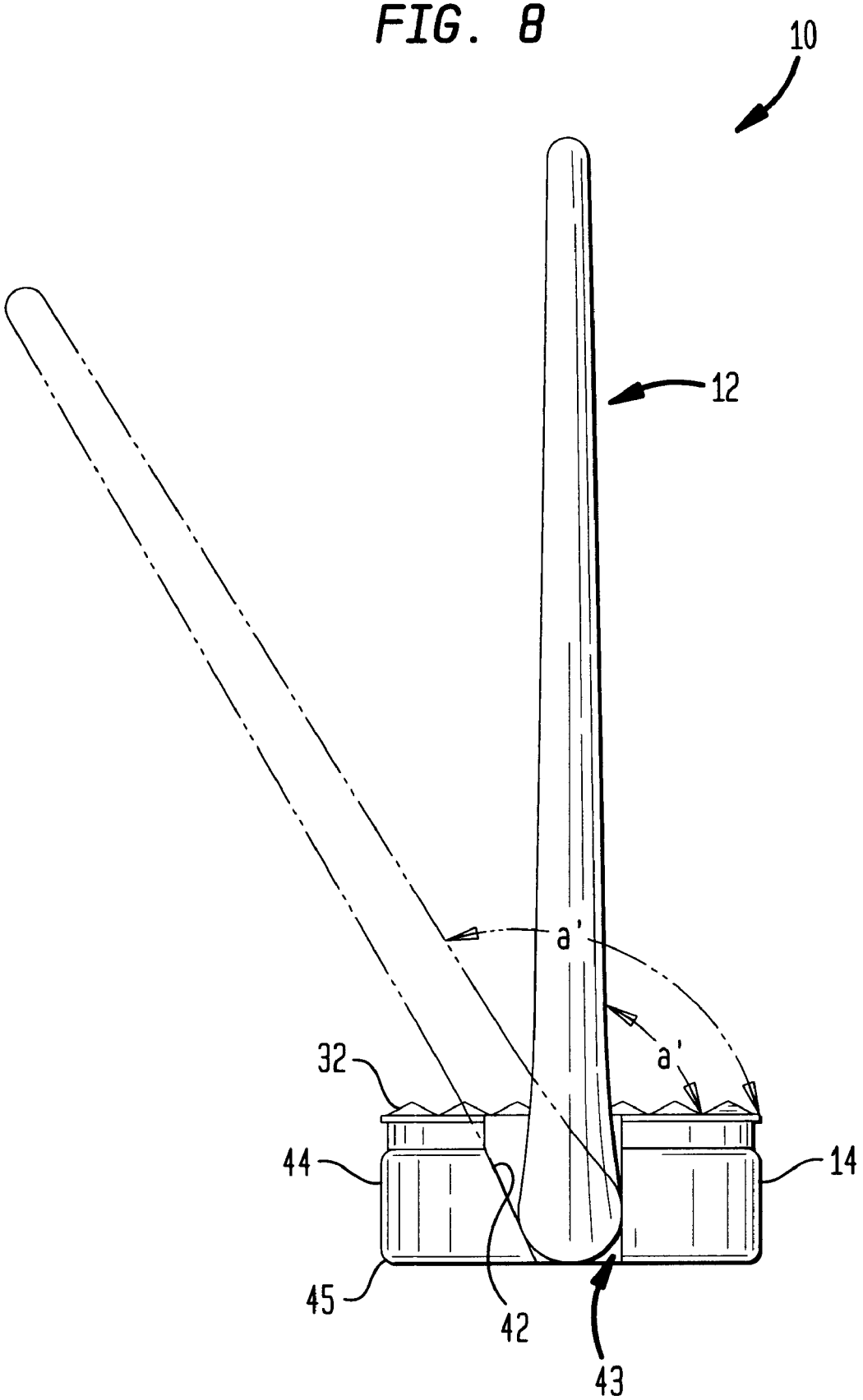
FIG. 8 is a side elevation view of the stirrup of FIG. 7 showing the vertical bearing wall and the tapered bearing wall.

The footplate 14 further defines a pair of side bar grooves 40. The lower ends 22 of the side bars 18 are disposed within these side bar grooves 40 such that when the footplate 14 is pivoted, the side bars 18 bear against one of either side of the side bar grooves. This bearing acts as a positive stop for the sidebars. That is, this bearing limits the pivoting of the footplate to a predetermined angle a' (FIGS. 6 and 8). In the preferred embodiment shown in FIG. 6, the predetermined angle may range between about 45° as measured between either side of the footplate 14 and the frame 12 to about 135° as measured between the same side of the footplate 14 and the frame 12. Preferably, the angle a' may be between 70° and 110°.

In a second preferred embodiment, as shown in FIG. 8, the predetermined angle a' may range between 90° and 135° as measured between the rear side of the footplate 14 and the frame 12, where the "rear" side means that side of the footplate 14 which faces towards the rear of the horse or other animal when the stirrup 10 is in position for use. Preferably, this angle a' may range between 90° and 110°.

In the preferred embodiment as shown in FIGS. 1–6 there is provided front bearing walls 42 and back bearing walls 43. In this embodiment, as best seen in FIG. 6, both front and back bearing walls taper from the top portion 44 of the footplate 14 to the bottom portion 45 of the footplate 14 toward the respective side bars 18. Thus, in this embodiment the footplate 14 will pivot to a predetermined angle as determined by the degree of taper from the top portion 44 to the bottom portion 45 of the footplate 14. An example of the range of pivot is shown as dashed lines in FIG. 6.

Figure 7:
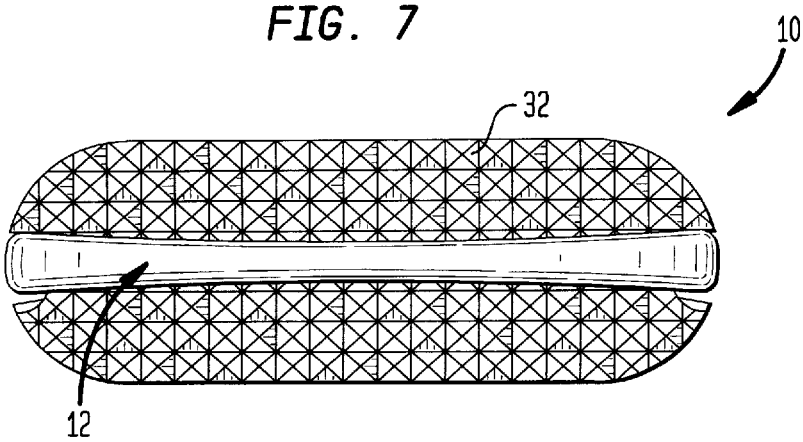
FIG. 7 is a top plan view of another embodiment of a stirrup of the present invention where the back bearing walls are vertical and the front bearing walls are tapered from the top portion to the bottom portion of the footplate.

In a second preferred embodiment, as shown in FIGS. 7 & 8, the back bearing walls 43 are vertical from the top portion 44 to the bottom portion the relation to the respective side bars 18. In this embodiment, therefore, the angle of rotation of the footplate 14, for instance with reference to FIG. 8, in a counterclockwise direction, would be relatively smaller than the angle of rotation of the footplate 14 in a clockwise direction since the front bearing wall 42 is tapered and thus allows for a relatively larger predetermined angle in the clockwise direction than does the back bearing wall 43 which is vertical. For purposes of orientation, it is to be understood that the back bearing walls are those walls closer to the rear of the footplate 14. An example of the range of pivot for this embodiment is shown as dashed lines in FIG. 8.

While the foregoing description of the figures illustrates preferred embodiments of the various techniques in accordance with the present invention, it should be appreciated that the invention also covers various embodiments which incorporate the inventive concepts underlying the foregoing described features, and that certain modifications may be made in the foregoing without departing from the spirit and scope of the present invention which are defined by the claims set forth immediately hereafter.

What is claimed is:

1. A stirrup for use by a rider, comprising:

(a) a frame, having a pair of side bars, said side bars defining first openings;

(b) a support bar extending between said side bars, said support bar being fixedly press-fit into said openings of said side bars; and (c) a footplate positioned between said side bars and being supported by said support bar, said side bars and said footplate defining a second opening for receiving the rider's foot therethrough, said footplate being pivotable with respect to said side bars; and said footplate further comprising side bar grooves in which said side bars are disposed.

2. The stirrup of claim 1, wherein said side bar grooves include front and back bearing walls such that when said footplate pivots, said side bars bear against either said front or said back bearing walls to thereby limit the angle to which the footplate pivots.

3. The stirrup of claim 2, wherein said footplate has a top portion and a bottom portion, and wherein at least said front bearing walls of said side bar grooves are at least partially tapered toward the respective said side bars from said top portion of said footplate to said bottom portion of said footplate.

4. The stirrup of claim 3, wherein said back bearing walls of said side bar grooves are vertical from said top portion to said bottom portion of said footplate.

5. The stirrup of claim 2, wherein said footplate has a top portion and bottom portion and wherein both said front and back bearing walls of said side bar grooves taper toward the respective said side bars from said top portion of said footplate to said bottom portion of said footplate.

6. A stirrup for use by a rider comprising:

(a) a frame, having a pair of side bars;

(b) a footplate having a top portion and a bottom portion, said footplate being positioned between and being pivotable with respect to said side bars, said side bars and said footplate defining an opening for receiving the rider's foot therethrough; and (c) said footplate further including side bar grooves which include front bearing walls and back bearing walls, wherein at least said front bearing walls of said side bar grooves are at least partially tapered toward the respective said side bars from said top portion of said footplate to said bottom portion of said footplate, such that when said footplate pivots, said side bars bear against either of said front or said back bearing walls to thereby limit the angle to which said footplate pivots.

7. The stirrup of claim 6, wherein said back bearing walls are vertical from said top portion to said bottom portion of said footplate.

* * * * *

UNITED STATES PATENT AND TRADEMARK OFFICE
CERTIFICATE OF CORRECTION

PATENT NO. : 5,930.986

DATED : August 3, 1999

INVENTOR(S) : Meaghan et al.

It is certified that error appears in the above-identified patent and that said Letters Patent is hereby corrected as shown below:

Column 5, line 20, after "bottom portion" insert --45 in--.

Column 5, line 20, cancel the word "the" (2nd occurrence).

Signed and Sealed this

Twenty-ninth Day of February, 2000

*Attest:*

*Attesting Officer*

Q. TODD DICKINSON

*Commissioner of Patents and Trademarks*